US010139177B2

(12) United States Patent
Giesen

(10) Patent No.: US 10,139,177 B2
(45) Date of Patent: Nov. 27, 2018

(54) FIREARM

(71) Applicant: Steyr Mannlicher GmbH, Kleinraming (AT)

(72) Inventor: Alexander Giesen, Hechingen (DE)

(73) Assignee: Steyr Mannlicher GmbH, Kleinraming (AT)

( * ) Notice: Subject to any disclaimer, the term of this patent is extended or adjusted under 35 U.S.C. 154(b) by 419 days.

(21) Appl. No.: 14/900,934

(22) PCT Filed: Apr. 25, 2014

(86) PCT No.: PCT/AT2014/050105
§ 371 (c)(1),
(2) Date: Dec. 22, 2015

(87) PCT Pub. No.: WO2015/000005
PCT Pub. Date: Jan. 8, 2015

(65) Prior Publication Data

US 2016/0377360 A1 Dec. 29, 2016

(30) Foreign Application Priority Data

Jul. 1, 2013 (AT) ..... A 50430/2013

(51) Int. Cl.
*F41A 11/02* (2006.01)
*F41A 15/14* (2006.01)
(Continued)

(52) U.S. Cl.
CPC ..... *F41A 11/02* (2013.01); *F41A 3/66* (2013.01); *F41A 15/14* (2013.01); *F41A 15/16* (2013.01); *F41A 21/48* (2013.01)

(58) Field of Classification Search
CPC .. F41A 11/02; F41A 3/66; F41A 21/48; F41A 15/14; F41A 15/16
(Continued)

(56) References Cited

U.S. PATENT DOCUMENTS 3,690,218 A * 9/1972 Maillard ..... F41A 3/26 89/185
3,882,625 A * 5/1975 Tellie ..... F41A 3/12 42/25
(Continued)

FOREIGN PATENT DOCUMENTS

| | | |
|---|---|---|
| DE | 19903326 | 6/2000 |
| EP | 1363099 | 11/2003 |
| EP | 2078915 | 7/2009 |

OTHER PUBLICATIONS

International Preliminary Report on Patentability for PCT/AT2014/050105 dated Apr. 25, 2014.
(Continued)

*Primary Examiner* — Michelle Clement
(74) *Attorney, Agent, or Firm* — Hoffmann and Baron, LLP

(57) ABSTRACT

The invention relates to a firearm including a component carrier, a barrel having a cartridge chamber for accommodating a cartridge, and a slide that is supported on the component carrier in a longitudinally moveable manner and has a breech block for the barrel and a firing device for the cartridge. The slide bears an extractor for extracting a fired cartridge from the cartridge chamber. An ejector is supported on the slide in a longitudinally moveable manner, which ejector protrudes from the side into the extraction motion path of the cartridge and lies against a stop formed on the component carrier in the end phase of the rearward motion of the slide. The slide, together with the ejector, can be modularly replaced with a second slide having no ejector. For the second slide, said stop assumes the ejector function.

18 Claims, 3 Drawing Sheets

(51) Int. Cl.
*F41A 15/16* (2006.01)
*F41A 3/66* (2006.01)
*F41A 21/48* (2006.01)

(58) Field of Classification Search
USPC ..... 42/25
See application file for complete search history.

(56) References Cited

U.S. PATENT DOCUMENTS 3,964,366 A * 6/1976 Atchisson ..... F41A 17/28 89/148
4,098,016 A * 7/1978 Foote ..... F41A 21/10 42/16
4,127,056 A * 11/1978 Kart ..... F41A 21/484 42/75.02
4,297,800 A * 11/1981 Atchisson ..... F41A 11/02 42/49.02
4,335,643 A * 6/1982 Gal ..... F41A 3/54 42/25
4,920,678 A * 5/1990 Brown ..... F41A 11/02 42/25
5,024,016 A * 6/1991 Smith ..... F41A 9/40 42/1.07
5,046,275 A * 9/1991 Brown ..... F41A 11/02 42/25
5,678,340 A * 10/1997 Moon ..... F41A 15/12 42/25
5,835,978 A * 11/1998 Canaday ..... F41A 15/12 89/138
6,182,389 B1 * 2/2001 Lewis ..... F41A 3/26 42/16
6,257,116 B1 * 7/2001 Moczijdlower ..... F41A 5/34 42/26
6,393,751 B1 * 5/2002 Liebenberg ..... F41A 3/64 42/25
6,425,199 B1 * 7/2002 Vaid ..... F41A 9/65 42/69.01
6,442,882 B1 * 9/2002 Dionne ..... F41A 5/04 42/15
6,560,909 B2 * 5/2003 Cominolli ..... F41A 17/46 42/70.05
6,718,680 B2 * 4/2004 Roca ..... F41A 9/45 42/70.08
7,469,496 B1 * 12/2008 Kellgren ..... F41A 15/10 42/46
7,596,900 B2 * 10/2009 Robinson ..... F41A 33/06 42/49.01
7,631,453 B2 * 12/2009 Longueira ..... F41C 7/00 42/16
7,726,230 B1 * 6/2010 Erdem ..... F41G 1/01 42/69.02
7,739,821 B1 * 6/2010 Hamme ..... F41A 3/06 42/2
7,971,379 B2 * 7/2011 Robinson ..... F41A 3/26 42/7
8,006,609 B2 * 8/2011 Kallio ..... F41A 17/42 42/14
8,037,805 B1 * 10/2011 Neroni ..... F41A 3/28 89/196
8,333,137 B2 * 12/2012 Sirochman ..... F41A 3/72 89/1.4
8,448,363 B2 * 5/2013 Fargnoli ..... F41A 3/54 42/16
8,745,910 B2 * 6/2014 Zukowski ..... F41A 15/14 42/25
8,819,976 B1 * 9/2014 Kellgren ..... F41A 21/482 42/6
9,097,478 B1 * 8/2015 Karagias ..... F41A 15/12
9,341,429 B1 * 5/2016 Reavis, III ..... F41A 35/02
9,429,379 B2 * 8/2016 Fellows ..... F41A 19/27
9,746,262 B2 * 8/2017 Fellows ..... F41A 19/25
9,823,031 B2 * 11/2017 Robbins ..... F41A 11/02
2004/0055198 A1 * 3/2004 Gussalli Beretta ..... F41A 15/14 42/46
2004/0159032 A1 * 8/2004 Szabo ..... F41A 15/14 42/46
2005/0011349 A1 * 1/2005 Rohrbaugh ..... F41A 5/04 89/147
2005/0115127 A1 * 6/2005 Szabo ..... F41A 15/14 42/46
2005/0262752 A1 12/2005 Robinson et al.
2006/0070288 A1 * 4/2006 Zedrosser ..... F41A 15/14 42/25
2006/0150467 A1 * 7/2006 Poulin ..... F41A 11/02 42/71.02
2006/0156606 A1 * 7/2006 Robinson ..... F41A 15/12 42/7
2006/0185212 A1 * 8/2006 Curry ..... F41A 15/14 42/46
2010/0162604 A1 * 7/2010 Dubois ..... F41A 11/02 42/18
2010/0242329 A1 * 9/2010 Carr ..... F41C 23/10 42/14
2010/0281735 A1 * 11/2010 Kallio ..... F41A 15/16 42/25
2010/0307042 A1 * 12/2010 Jarboe ..... F41A 3/18 42/6
2011/0088304 A1 * 4/2011 Lorenzut ..... F41A 5/12 42/1.06
2011/0168009 A1 * 7/2011 Robb ..... F41A 3/54 89/194
2011/0232149 A1 * 9/2011 Fargnoli ..... F41A 3/54 42/16
2011/0252957 A1 * 10/2011 Overstreet ..... F41A 3/12 89/128
2011/0277368 A1 * 11/2011 Overstreet ..... F41A 3/64 42/108
2012/0005931 A1 * 1/2012 Kelly ..... F41A 21/10 42/14
2012/0023801 A1 * 2/2012 Rozum ..... F41A 17/00 42/70.08
2012/0167427 A1 * 7/2012 Zukowski ..... F41A 15/14 42/25
2012/0180646 A1 * 7/2012 Wossner ..... F41A 3/66 89/191.01
2012/0317856 A1 * 12/2012 Burke ..... F41A 11/02 42/16
2013/0047833 A1 * 2/2013 Steimke ..... F41A 5/26 89/191.01
2013/0139424 A1 * 6/2013 Devine ..... F41A 3/26 42/16
2014/0059910 A1 * 3/2014 Norton ..... F41A 3/26 42/9
2014/0068985 A1 * 3/2014 Emde ..... F41A 9/65 42/6
2014/0075807 A1 * 3/2014 Lewis ..... F41A 15/14 42/25
2014/0076144 A1 * 3/2014 Gomez ..... F41A 3/38 89/132
2014/0137454 A1 * 5/2014 Lee ..... F41A 15/14 42/25
2015/0040451 A1 * 2/2015 Young ..... F41A 15/16 42/25
2015/0128468 A1 * 5/2015 Doiron ..... F41A 15/14 42/25
2015/0198394 A1 * 7/2015 Hochstrate ..... F41A 3/26 42/17
2015/0323267 A1 * 11/2015 Donnelly ..... F41A 3/54 89/139
2015/0323273 A1 * 11/2015 McGinty ..... F41A 35/06 42/25
2015/0330731 A1 * 11/2015 Kolev ..... F41A 3/12 42/25
2015/0369553 A1 * 12/2015 Stussak ..... F41A 15/12 42/25
2016/0047613 A1 * 2/2016 Hudson, III ..... F41A 3/86 42/14

(56) References Cited

U.S. PATENT DOCUMENTS

| | | | | |
|---|---|---|---|---|
| 2016/0109207 | A1* | 4/2016 | Buchel | F41A 3/66<br>42/7 |
| 2016/0146558 | A1* | 5/2016 | Kada | F41A 3/56<br>42/16 |
| 2016/0377361 | A1* | 12/2016 | Osborne | F41A 9/17<br>42/11 |
| 2018/0023912 | A1* | 1/2018 | Cudazzo | F41A 3/54<br>89/136 |

OTHER PUBLICATIONS

Austrian Office Action dated Jan. 29, 2014 for Application A 50430/2013.

* cited by examiner

FIREARM

CROSS-REFERENCE TO RELATED APPLICATIONS

This application is a National Phase application of International Application No. PCT/AT2014/050105 filed Apr. 25, 2014 which designated the U.S. and claims priority to Austrian Patent Application No. A 50430/2013 filed Jul. 1, 2013, the disclosures of which are herein incorporated by reference in their entireties.

BACKGROUND

The present application relates to a firearm comprising a component carrier, a barrel having a cartridge chamber for accommodating a cartridge, and slide, which is supported on the component carrier in a longitudinally moveable manner and has a breech block for the barrel and a striking device for the cartridge, wherein the slide bears an extractor for extracting a fired cartridge from the cartridge chamber, wherein an ejector is supported on the slide in a longitudinally moveable manner, which ejector protrudes from the side into the extraction motion path of the cartridge and, in the end phase of the rearward motion of the slide, lies against a stop formed on the component carrier.

A firearm of this type is known from EP 1 363 099 A1. The extractor interacts with the ejector (discharger), against which the cartridge laterally butts or lies against during extraction with its cartridge base, through which it tilts and is ejected, e.g., by means of a lateral window or an opening of the slide. The ejector has to be matched to the calibre of the cartridge used, to protrude into the motion path of the cartridge with the right amount to thereby cause its tilting. In EP 1 363 099 A1, the ejector moves during the extraction movement of the cartridge together with the slide, until it butts against the back wall of the component carrier of the firearm in the end phase of the extraction movement, thus gaining its function as an ejector protruding into the motion path of the cartridge and tilting the cartridge.

For arms with replaceable systems, for which for shooting, e.g., small calibre or colour marking cartridges (FX-cartridges) for training purposes the barrel (or at least its cartridge chamber) is replaced with a smaller calibre, also the contact point of the ejector changes due to the reduced cartridge diameter and/or the different barrel, which leads to malfunction.

SUMMARY

The present application sets its aim to solve this problem and to create a firearm with an improved function for use with different ammunition.

This aim is achieved with a firearm of the type mentioned in the introduction, wherein according to an embodiment the whole slide, together with the ejector, can be modularly replaced with a second slide having no ejector, for which second slide said stop assumes the ejector function. When using a slide without an ejector, the firearm thus has a rigid "substitute"-ejector in form of the stop on the component carrier. By merely replacing the slide or the upper housing part, respectively, once with and once without an ejector, a replaceable system for different types of ammunition can thus be created in conjunction with different barrels (or cartridge chambers), wherein the ejector function is always optimally fitted to the diameter and to the extracting motion path of the cartridge. Optionally, the ejector is mounted in a modularly replaceable manner in the slide.

In one embodiment of the present application, the ejector has an elongated middle section, which slides on the stop, and a hook-like end section, which lies against the stop in said end phase. Thus, the slide, together with the ejector, can simply be put onto the component carrier with the stop from above or from the front in a sliding manner.

The ejector only has to be longitudinally moveable in the slide by at least this moving distance that corresponds to the end phase of the extracting movement, in which the extractor pulls the cartridge on an edge of its cartridge base even further to the back, while the cartridge base lies at the opposite edge against the fixed ejector, i.e., the tilting path of the cartridge base. If desired, the ejector can also be moveable over a longer shifting distance in the slide. Optionally, the ejector is loaded by a spring to the back, with respect to the slide, i.e., springly pre-loaded towards the back, such that it moves during the forward movement of the slide into a position which affects the cartridge as little as possible.

According to a further embodiment of the present application, the barrel is a replaceable barrel. A first barrel can, e.g., be a rigid barrel, which is modularly replaceable with a second barrel, which is mounted so that it can be tilted down. In conjunction with a modularly replaceable slide, this yields an advantageous modular weapon system, in which, e.g., on the one hand, a tilt-down barrel for high-energetic ammunition interacts with a slide having no ejector with a locking breech block or, on the other a hand, a rigid barrel for small calibre or FX-ammunition interacts with an ejector slide with a blowback system.

In any case, it is especially advantageous if the firearm has a housing separated into a lower part and an upper part, wherein the component carrier lies in the lower housing part and the slide forms the upper housing part. Thereby, a modularly replaceable system is created, for which the lower part of the firearm can always remain the same and which can be combined with different slides and barrels for different types of ammunition.

BRIEF DESCRIPTION OF THE DRAWINGS

The present application shall now be explained in more detail on the basis of an exemplary embodiment, which is depicted in the accompanying drawings. In the drawings.

DETAILED DESCRIPTION

Figure 1:
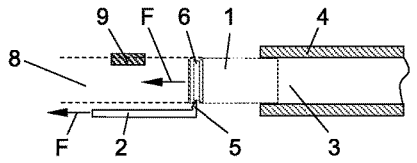
FIGS. 1 and 2 show the principle of the function of an ejector schematically in a sectional view.
Figure 2:
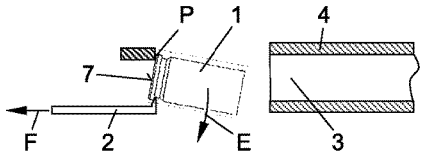
Figure 3:
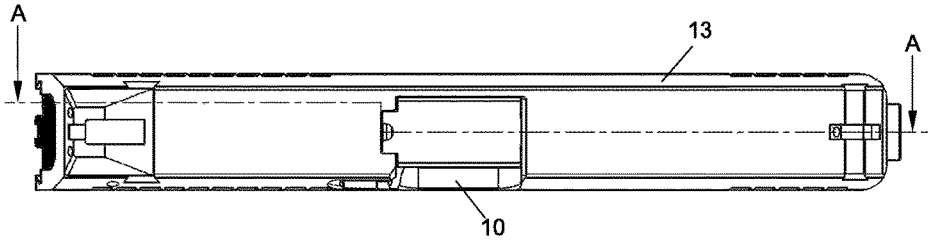
FIGS. 3 and 4 show the upper housing part of a firearm according to an embodiment in a top view (FIG. 3) and in a cross-section at the level of the extractor and the ejector (FIG. 4)
Figure 4:
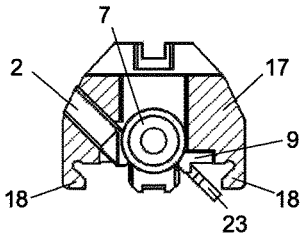

By means of FIGS. 1 and 2, the operating mode of an extractor interacting with an ejector in a firearm is briefly explained. After firing a shot, a fired cartridge 1 ("empty cartridge case") is pulled out, in the direction of the arrow F to the back, of a rear part or cartridge chamber 3 of a barrel 4 (only partially depicted) by means of an extractor 2. The extractor 2 thereby engages with a hook-like part 5 from the side into a groove 6 next to the cartridge base 7 of the cartridge 1. Into the movement path 8 of the cartridge 1 during extraction an ejector 9 protrudes laterally, against which the fired cartridge 1 in the end phase (FIG. 2) of its extraction movement butts at a point P, approximately opposite of the contact point of the extractor 2, tilts during the further movement of the extractor 2 in the direction of arrow F and is thereby ejected in the direction of the arrow E, e.g., via a lateral window 10 (FIG. 3) of the firearm.

When using different ammunition, i.e., cartridges 1 with different diameters or calibres, respectively, for which, e.g., replaceable barrels of different calibres are used, the contact point P of the ejector 9 is shifted, which can lead to malfunctions. To solve this, the measures explained in the following are used.

In FIGS. 3 to 8, a firearm 11 and parts of which, respectively, are illustrated. The firearm 11 is in the present case a pistol, but it is understood that the firearm 11 can also be a rifle, e.g., a hunting or assault rifle.

The firearm 11 comprises a lower housing part 12 and an upper housing part 13. The lower housing part 12 includes a component carrier 14 (FIGS. 5, 7*a*), optionally made out of metal, which bears the components relevant for shooting and defines them as to their relative positions towards each other, such as a barrel 15, a breech block 16 interacting with it, and (not depicted) a striking device for the cartridge 1, a trigger device for the striking device, and a magazine, as known in the state of the art.

Figure 6A:
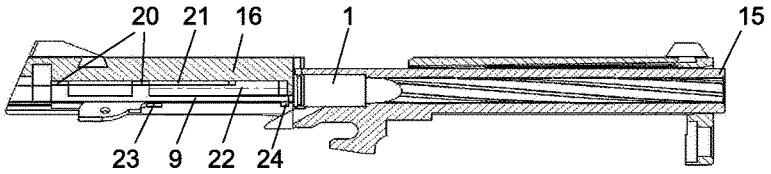
FIGS. 6*a* to 6*c* each show a longitudinal sectional view through the upper housing part of FIG. 3 with a barrel along the section line A-A of FIG. 3 in three different operating positions.
Figure 6B:
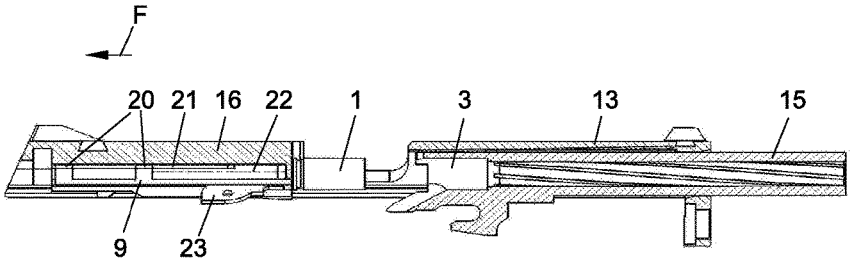
Figure 6C:
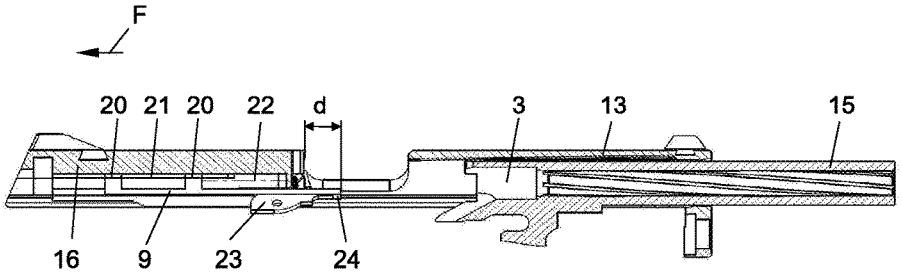

The breech block 16 is mounted in a slide 17, which is, for example, mounted by means of dovetail guides 18, 19 on the component carrier 14 in a longitudinal direction of the firearm 11 (firing direction of the barrel 15) in a longitudinally moveable manner, see FIGS. 6*a* to 6*c*. The locking of the breech block 16 with the barrel 15 is not shown in detail and can be carried out in any form as known in the state of art. For example, the barrel 15 is a controlled tilting barrel, which tilts after firing a shot on its back end downwards by a few millimeters to release a locking connection with the breech block 16. Different types of breech blocks are also possible, for example, the slide 17 can contain a rotary piston breech block.

In the shown example, the slide 17 is embodied in form of a sliding upper housing part 13, which also covers the barrel 15, and thereby contains the breech block 16; alternatively, the slide 17 can also directly form the breech block 16 or can be formed integrally with it, respectively, and not cover the barrel 15. The distribution of the components of the lower housing part 12 can also be different than depicted, for example, the component carrier 14 can itself form the lower housing part 12, i.e., be integrally embodied with it. The choice of material is arbitrary, for example, one or more parts can be made out of cheap plastic material instead of metal, as far as possible.

The barrel 15 is optionally modularly replaceable with a replacing barrel of a different calibre or at least be equipable with adapter rings (not depicted) for narrowing the cartridge chamber 3 for training ammunition of small calibre. For example, a first, rigid barrel 15 for training ammunition of small calibre or FX-cartridges can be used together with a breech block that is not locked ("blowback system"), which can be exchanged for a second ("controlled") barrel which can be tilted down for actual use ammunition of a large calibre, which interacts with a lockable breech block 16 in said manner. In this way, for example, the whole upper housing part 13 with the breech block 16 and the barrel 15 can be exchanged, while the upper housing part 12 with magazine, trigger device, cocking device, and so forth, remains the same.

For the modular replacing system of the firearm 11, an ejector 9 is used, which is mounted in a moveable manner in the slide 17. The ejector 9 slides with lateral lugs 20 in longitudinal guides 21 of the slide 17 and is mounted moveably between a first position (FIGS. 6*a*, 6*b*, 7*a*, 7*b*), which is shifted backwards with respect to the slide 17, and a second position (FIG. 6*c*), which is shifted to the front by a distance d with respect to the slide 17. A pressure spring 22 between an inner ledge of the slide 17 and, for example, one of the lugs 20 pre-cocks the ejector 9 into the rearward position (FIGS. 6*a*, 6*b*, 7*a*, 7*b*). This is advantageous, but not mandatory, and the pressure spring 22 can also be omitted.

Figure 7A:
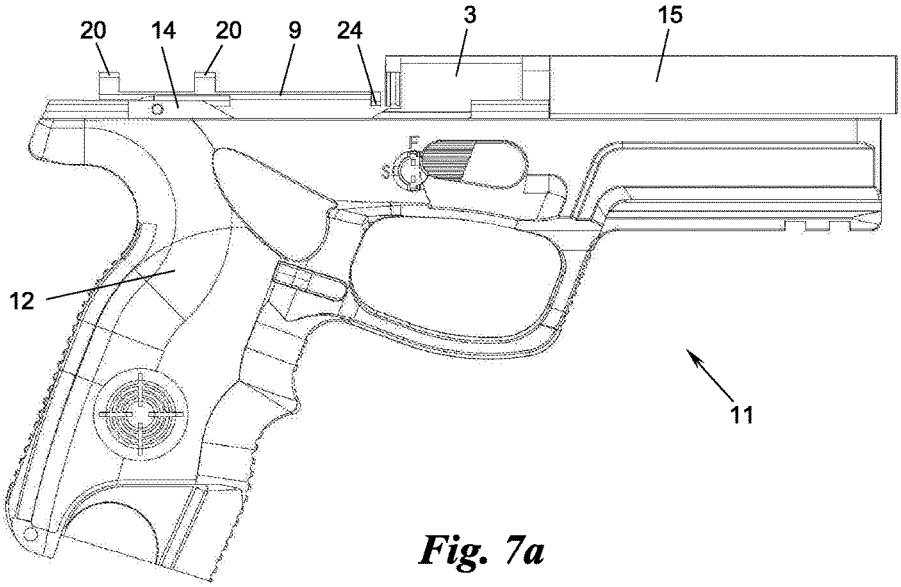
FIGS. 7*a* and 7*b* show a side view and a partial side view, respectively, of the firearm of an embodiment with the upper housing part taken off in two different operating positions corresponding to the operating positions of FIGS. 6*a* and 6*b*.
Figure 7B:
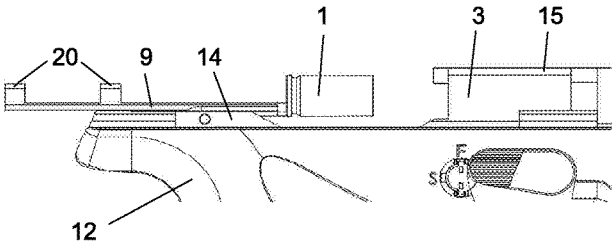
Figure 8:
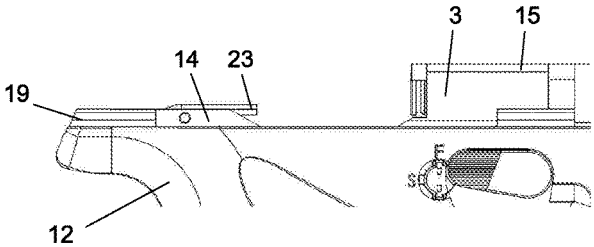
FIG. 8 shows a partial side view of the firearm of an embodiment in a position during use for a slide without an ejector.

If the slide 17 is moved towards the back together with the extractor 2 (FIG. 4) for extracting the empty cartridge 1 (FIG. 6*a*→FIG. 6*b*; FIG. 7*a*→FIG. 7*b*), the ejector 9 initially moves together with the slide 17. In the end phase of the extracting movement (FIG. 6*b*→FIG. 6*c*), the ejector 9 is locked with respect to the component carrier 14 in that the ejector 9 butts against a stop 23 embodied on the component carrier 14. In the shown example, a forward hook-like end part 24 of the ejector 9 strikes against the front face of the stop 23. The ejector 9 is thereby stopped, while the slide 17 moves further back by a distance d, whereby the ejector 9 protrudes to the front with respect to the slide 16 (FIG. 6*c*) and can thus perform an ejecting function as shown in FIG. 2 to eject the cartridge 1.

It is understood that the ejector 9 could also butt against a stop 23 on a different position of the component carrier 14, e.g., with its rearward end on a stop 23 located further at the back. The ejector 9 could then be embodied substantially shorter than depicted. The shown embodiment with a very elongate ejector 9 protruding far to the front having a hook-end has the advantage that it can interact with a stop 23 located at the very front, which can thereby assume a double function: If the slide 17 or upper housing part 13, respectively, with the ejector 9 is removed and replaced with a slide without an ejector (not depicted), the stop 23 located at the very front can then simultaneously assume the function of a "regular" rigid ejector 9 according to FIG. 2.

The moveable ejector 9 of the slide 17, which here quasi "rides" over the stop 23, thus protrudes more into the movement path 8 of the cartridge 1 than the stop 23 acting as the "replacement" ejector. The slide 17 without an ejector and the stop 23 as a replacement ejector thus can, e.g., be combined with a barrel 15 for ammunition of a large calibre or a lockable tilt-down barrel 15 for high-energy ammunition; and a slide 17, which is equipped with a moveable ejector 9, can, e.g., be combined with a barrel 15 for small calibre or training ammunition. By merely replacing the slide 17 or upper housing part 13, respectively, once with and once without an ejector 9, together with different barrels 15 (or cartridge chambers 3), a replacing system for different ammunitions can be created, wherein the ejector function is always fitted optimally to the diameter and to the extraction movement path of the cartridge.

Figure 5:
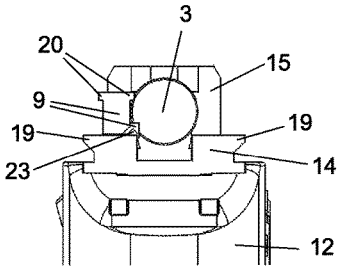
FIG. 5 shows a partial rear view of the firearm of an embodiment with the upper housing part taken off.

As shown in FIG. 5, the stop 23 has in its cross section approximately a triangular shape, and the ejector 9 is embodied, on its side facing the stop 23, in form of a triangular channel, such that the ejector 9 can simply be placed on the stop 23 from above or in a longitudinal direction and is then guided on it in a rail-like manner, which simplifies the replacement of the slide 17. Thus, the slide 17 can be detracted, e.g., in the release direction of the dovetail connection 18, 19, and thus the ejector 9 and the stop 23 can be separated from each other.

In the simplest case, the ejector 9 in the slide 17 can merely be embodied as a moveable bolt or pin which protrudes in the end phase of the slide movement by the movement distance d with respect to the slide 17 to initiate the tilting movement (FIG. 2). To this end, the ejector 9 can stop on every arbitrary stop 23, which is embodied on the component carrier 14 or lower housing part 12, respectively.

The present application is not restricted to the specific embodiments described in detail herein but encompasses all variants and modifications thereof that fall within the framework of the appended claims.

What is claimed is:

1. A firearm comprising:

a component carrier;

a barrel having a cartridge chamber configured for accommodating a cartridge; and a slide, which is supported on the component carrier in a longitudinally moveable manner and has a breech block for the barrel and a striking device for the cartridge;

wherein the slide bears an extractor configured for extracting a fired cartridge from the cartridge chamber;

wherein an ejector is supported on the slide in a longitudinally moveable manner, which ejector protrudes into an extraction motion path of the cartridge and, in the end phase of the rearward motion of the slide, lies against a stop formed on the component carrier; and wherein the slide, together with the ejector, can be modularly replaced with a second slide having no ejector, wherein said stop formed on the component carrier assumes the ejector function for said second slide.

2. The firearm according to claim 1, wherein the ejector is mounted in a modularly replaceable manner in the slide.

3. The firearm according to claim 1, wherein the ejector has an elongated middle section, which slides on the stop, and a hook-like end section, which, in said end phase, lies against the stop.

4. The firearm according to claim 1, further comprising a spring which loads the ejector to the back with respect to the slide.

5. The firearm according to claim 1, wherein the barrel is a replaceable barrel.

6. The firearm according to claim 1, wherein the barrel is a rigid barrel, which is modularly replaceable with a second barrel that can be tilted down.

7. The firearm according to claim 1, having a housing separated into a lower part and an upper part, wherein the component carrier lies in the lower housing part and the slide forms the upper housing part.

8. A firearm comprising:

a lower part and an upper part, the upper part comprising a first slide being supported on the lower part, the first slide being longitudinally moveable with respect to the lower part, wherein the first slide includes an extractor adapted to pull out a fired cartridge from a cartridge chamber, wherein the first slide further includes an ejector supported thereon such that the ejector moves longitudinally with respect to the slide and protrudes into an extraction motion path of the cartridge and, at an end of a rearward motion of the first slide, the ejector butts up against a stop formed on the lower part as the slide continues to move rearward thereby ejecting the cartridge; wherein the first slide together with the ejector can be removed and replaced with a second slide associated with a barrel of a calibre different from the first slide and wherein the second slide does not include an ejector, wherein the stop formed on the lower part functions as the ejector for the second slide to eject a second cartridge of a different calibre than that associated with the first slide.

9. The firearm according to claim 8, wherein the first slide is associated with a barrel of a calibre smaller than the barrel associated with the second slide.

10. The firearm according to claim 8, wherein the ejector has an elongated middle section, which slides on the stop, and a hook-like end section, which, at an end of the rearward motion, lies against the stop.

11. The firearm according to claim 8, further comprising a spring which loads the ejector to the back with respect to the slide.

12. The firearm according to claim 8, further comprising a replaceable barrel.

13. The firearm according to claim 12, wherein the replaceable barrel is a rigid barrel or a barrel that can be tilted down.

14. The firearm according to claim 8, wherein the ejector is modularly removeable from the slide.

15. The firearm according to claim 8, wherein the lower part includes a component carrier.

16. The firearm according to claim 15, wherein the component carrier includes the stop.

17. The firearm according to claim 15, wherein the component carrier supports the first and second slide.

18. The firearm according to claim 8, wherein the first and second slide include a breech block for the barrel and a striking device for the cartridge.

* * * * *